US006889463B2

(12) United States Patent
Orth

(10) Patent No.: US 6,889,463 B2
(45) Date of Patent: May 10, 2005

(54) RIFLE COMPRISING A STOCK, A FOREARM AND A BARREL

(75) Inventor: Manfred Orth, Heckenweg 18, Vellmar (DE), 34246

(73) Assignees: Manfred Orth, Vellmar (DE); Wihelm Goddek, Lohfelden (DE); Josef Beer, Kempten (DE)

( * ) Notice: Subject to any disclaimer, the term of this patent is extended or adjusted under 35 U.S.C. 154(b) by 205 days.

(21) Appl. No.: 10/351,704

(22) Filed: Jan. 27, 2003

(65) Prior Publication Data

US 2003/0150151 A1 Aug. 14, 2003

(30) Foreign Application Priority Data

Feb. 9, 2002 (DE) ..... 102 05 503

(51) Int. Cl.[7] ..... F41C 23/00
(52) U.S. Cl. ..... 42/75.03; 42/75.02; 42/75.01
(58) Field of Search ..... 42/75.01, 75.02, 42/75.03

(56) References Cited

U.S. PATENT DOCUMENTS 4,103,586 A * 8/1978 Tollinger ..... 89/144
4,519,156 A * 5/1985 Shaw ..... 42/77
4,541,192 A * 9/1985 Flodman et al. ..... 42/40
4,648,191 A * 3/1987 Goff et al. ..... 42/75.02
4,729,186 A * 3/1988 Rieger ..... 42/75.04
5,247,758 A * 9/1993 Mason ..... 42/75.02
5,311,692 A * 5/1994 Blaser ..... 42/42.01
5,410,834 A * 5/1995 Benton et al. ..... 42/75.02
5,454,182 A * 10/1995 Lewis et al. ..... 42/51
5,540,008 A * 7/1996 Kirnstatter ..... 42/75.02
5,813,158 A * 9/1998 Campbell et al. ..... 42/75.03
6,293,040 B1 * 9/2001 Luth ..... 42/75.01
6,415,701 B1 * 7/2002 Dobbins ..... 89/1.41
6,470,616 B1 * 10/2002 Clay ..... 42/75.02
6,470,617 B1 * 10/2002 Gregory et al. ..... 42/75.04

FOREIGN PATENT DOCUMENTS

DE 198 15 261 12/1999

* cited by examiner

*Primary Examiner*—Troy Chambers
(74) *Attorney, Agent, or Firm*—Jordan and Hamburg LLP

(57) ABSTRACT

The subject matter of the invention is a rifle (1) comprising a stock (40), a forearm (30) and a barrel (20), the barrel (20) being releasably connectable to the stock (40) and said barrel (20) being fastenable to said stock (40) by bringing the forearm (30) into locking engagement with said stock (40) by means of a locking device (50), the locking device (50) being spring-loaded and the spring (60) being compressed by an actuation member (57) for the purpose of unlocking.

9 Claims, 3 Drawing Sheets

RIFLE COMPRISING A STOCK, A FOREARM AND A BARREL

FIELD OF THE INVENTION

The present invention relates to a rifle comprising a stock, a forearm and a barrel, the barrel being releasably connectable to the stock and fastenable to said stock by bringing the forearm into locking engagement with said stock by means of a locking device.

Experts use the term "takedown rifle" when speaking of a rifle the barrel of which is detachable from the stock. Such type rifles, the barrel of which may be separated from the stock, are particularly suited for use when a rifle must be transported or when the barrel is wished to be interchangeable.

DESCRIPTION OF THE PRIOR ART

In a prior art takedown rifle the barrel is clampingly received by the chamber of the stock. For this purpose the chamber has a lengthwise slotted sleeve-like projection which is provided with clamping screws in the region of the slot. Said clamping screws serve to vary the width of the slot so that the barrel may be clampably fastened in the slotted sleeve-like projection of the chamber. The disadvantage of this rifle is that after each assembly the barrel adopts another position relative to the stock so that the aiming situation is a different one after each assembly as a result thereof. This is substantially due to the fact that the barrel of the rifle is oriented relative to the stock in function of the tightening torque of the various clamping screws.

DE 198 15 261 C2 describes a rifle that can disassemble into three parts and the barrel of which is fastened to the stock through the forearm. Beneath the stock housing, the stock is thereby provided with a groove that opens toward the front side of the stock. A corresponding nose of the barrel is insertable into said groove. The groove is closed by the front side of the forearm so that the barrel is fastened to the stock through the forearm. The forearm is fastened to the stock by way of a dovetail guide that is oriented normal to the longitudinal axis of the barrel on the front side between forearm and stock. In order to prevent the forearm from unintentionally detaching from the stock there is provided a locking device in the form of a movable pin, the movement of the forearm relative to the stock being blocked by said pin. The movable pin communicates with a lever provided on the forearm, the pin being capable of being snapped into engagement with the stock or of being disengaged from this position of engagement through said lever. It is to be noted here that it is not necessary to lock the barrel to the stock during firing since, in the repeated condition, the barrel is connected with form-positive fit to the housing and, as a result thereof to the stock, through the chamber body. Accordingly, the barrel needs only be fastened to the stock through the forearm in the non-repeated condition i.e., during repetition because during repetition there is a risk that the chamber body or the cartridge inserted in the chamber pulls the barrel forward and out.

This known rifle is i.a. characterized in that it offers the same aiming situation at each shot regardless of how often it has been assembled and disassembled. The reason therefore is that the barrel is not clamped to the housing of the stock as it is the case with prior art rifles in which the barrel is clampingly received by the housing of the stock.

To lock the forearm to the stock is a quite complicated operation though so that it is an object of the invention to develop a rifle of the type mentioned herein above in such a manner that it is easier to operate, i.e., to disassemble and assemble, but still offers the same aiming situation after each disassembling and subsequent assembling procedure so that the barrel is not connected to the stock by a nonpositive engagement.

BRIEF SUMMARY OF THE INVENTION

The solution to this object in accordance with the invention is to provide a spring-loaded locking device, the spring being compressed by an actuation member for the purpose of unlocking. To fasten, i.e., to lock the forearm to the stock there is provided that the spring activates the locking device whereas to release the engagement the actuation member only needs to be displaced against the force of the spring to disengage the locking device and to thus separate the forearm from the stock.

Further advantageous features are recited in the subordinate claims.

More specifically, the locking device comprises a spring-loaded piston and locking members which are for example configured as balls and seated on the circumference of the piston, said locking members being capable of being brought into a locking position through the piston. It is obvious therefrom that the locking device substantially consists of the spring-loaded piston, the locking members and the actuation member thereof, e.g., a piston rod, which are considerably less expensive to manufacture than the prior art locking device. The piston more specifically has a leading bevel edge for radially displacing the locking members. The leading bevel edge causes the locking members to be radially displaced outward so that they reach their locking position, said locking members remaining in this basic position on account of the spring load of the piston. Only by actuating the piston rod that extends through the forearm parallel to the longitudinal axis thereof are the locking members brought into the unlocking position by the displacement of the piston against the force of the spring. In this case, the locking members are seated on the piston rod the diameter of which is much smaller than the diameter of the piston in the region of the leading bevel edge.

To receive the locking device the forearm has a sleeve-like projection, the stock being provided with a bore for receiving said sleeve-like projection. More specifically, the sleeve-like projection is further provided, in the region of the leading bevel edge, with apertures for the locking members, said apertures being spaced around the circumference, engaging means in the form of a contouring groove disposed on the inner circumference being provided on the inner circumference of the bore in the stock for the engagement of the locking members. The bore of the stock is advantageously lined with a sleeve provided with the contouring groove for the locking members.

The invention will be explained in closer detail hereinafter with reference to the drawing.

DETAILED DESCRIPTION OF THE INVENTION

Figure 1:
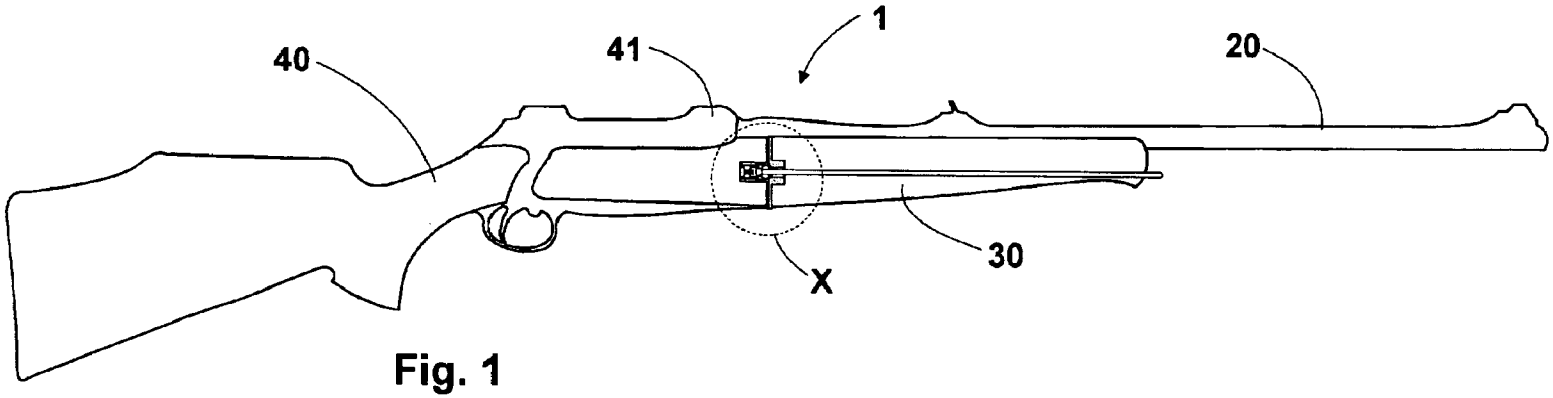
FIG. 1 is a side view of the rifle.

The rifle indicated generally at 1 shows the barrel 20, the forearm 30 and the stock 40. The stock 40 has the housing 41, the stock 40 being provided in the region of the housing 41 with a groove 43 oriented parallel to the longitudinal axis of the stock 40. The barrel 20 is provided with a sleeve 21 and with a nose 22 disposed beneath the sleeve for slidable reception into the groove 43. After the forearm 30 has been attached, the groove 43 is blocked by the front side 31 of the forearm 30 in such a manner that the nose 22 of the barrel cannot slip out of the groove 43.

Figure 3:
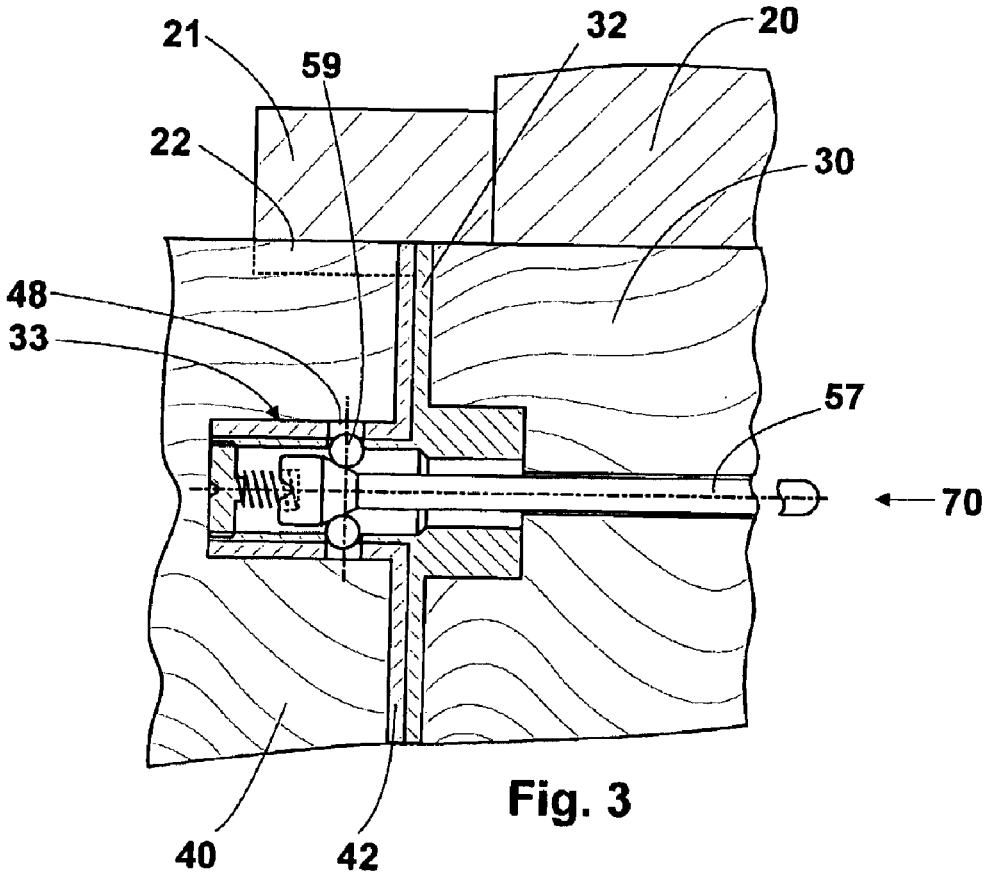
FIG. 3 is an enlarged detail „X" of FIG. 1, the forearm being locked to the stock.
Figure 4:
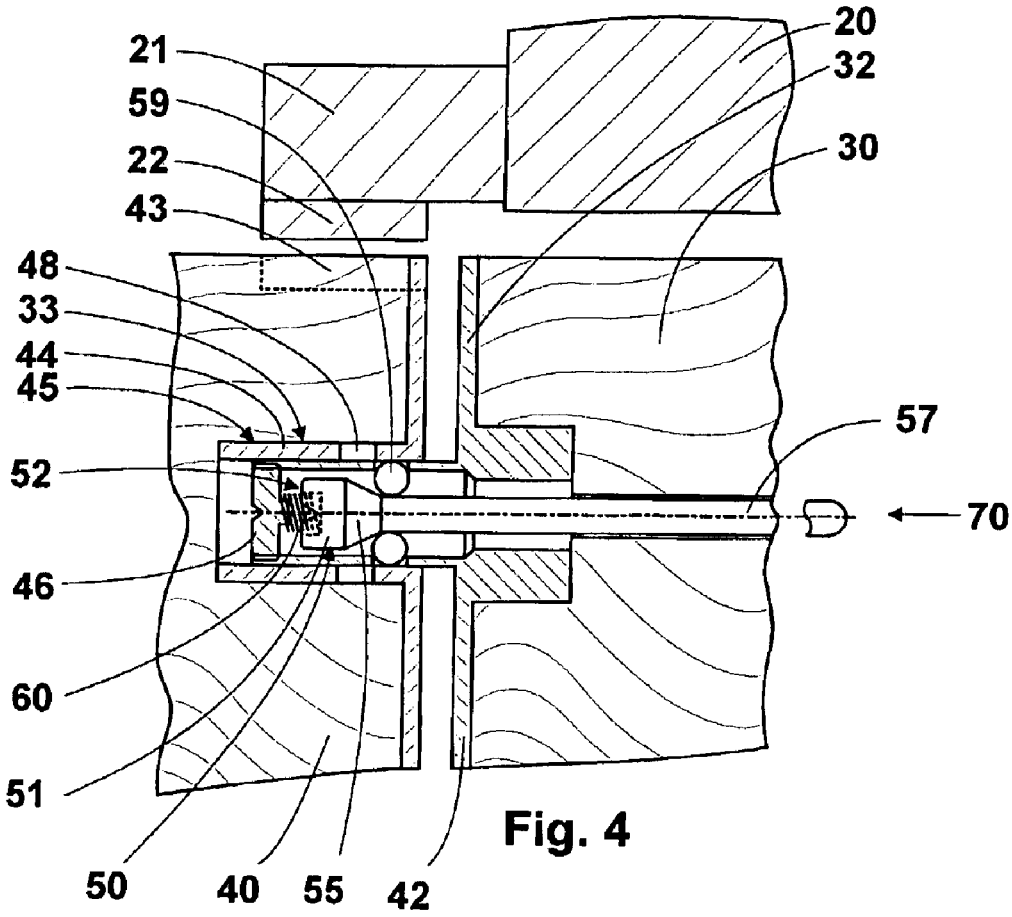
FIG. 4 is the detail „X" of FIG. 1 in the unlocked condition.

The FIGS. 3 and 4 more specifically show the locking of the forearm 30 to the stock 40. On its front side (arrow 31) the forearm 30 has a front plate 32. The front plate 32 comprises the sleeve-like projection 33 that receives the locking device 50. The stock 40 also has a front plate 42 which abuts on the front plate 32 of the forearm when the forearm and the stock are assembled. The front plate 42 of the stock has a sleeve 44 projecting into the bore 45 of the stock, the size of said sleeve matching that of the sleeve-like projection 33.

Figure 2:
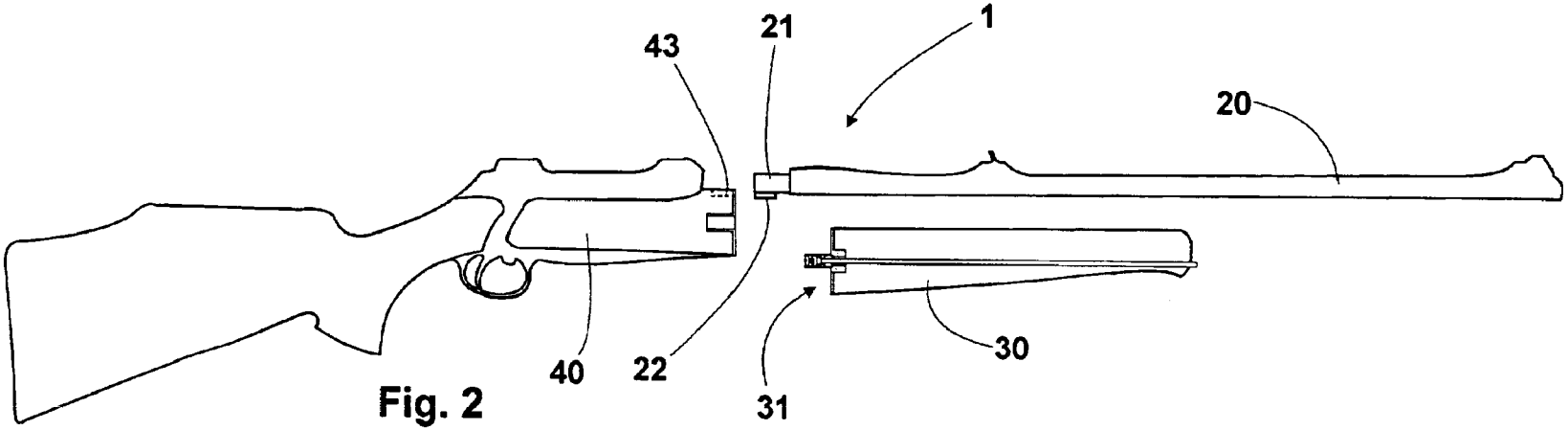
FIG. 2 is also a side view of the rifle, the three parts thereof, i.e., the stock, the barrel and the forearm, being shown disassembled.

The locking device 50 comprises the piston 51 and the locking members configured as balls 59, the piston being supported in the region of the bottom 52 thereof on the bottom 46 of the bore by a spring 60. The piston 51 is provided with the conical leading bevel edge 55 for the balls 59 and, adjacent thereto, with the piston rod 57 the diameter of which is thus that, when the balls abut on the piston rod, the sleeve 44 is released by the balls 59. As can be surveyed from the FIGS. 1 and 2, the piston rod 57 longitudinally extends through the forearm 30 so that it is actuatable from the outside.

When the forearm is locked to the stock in the manner shown in FIG. 3, the conical leading bevel edge 55 pushes the balls 59 through the corresponding apertures 38 in the sleeve-like projection 33 into the groove or slot 48 disposed on the inner circumference of the sleeve 44. In this condition the forearm cannot be detached from the stock. On actuating the piston rod 57 in the direction of the arrow 70 the spring 60 is compressed and, upon removing the forearm from the stock, the balls 59 are next brought into the position shown in FIG. 4 in which they no longer abut on the leading bevel edge of the piston.

I claim:

1. A rifle comprising:

a stock;

a forearm;

a barrel releasably connectable to the stock by bringing the forearm into locking engagement with said stock;

a locking device for attaching and detaching said forearm to and from said stock, the locking device having:

a spring-loaded rod;

a spring biasing said rod into a position effecting locking said forearm to said stock;

an actuation member for unlocking said forearm from said stock by advancing said rod to compress said spring and move from the position effecting locking said forearm to said stock to a position effecting unlocking of said forearm from said stock by actuation of said actuation member;

locking members seated on a circumference of the rod, said locking members being capable of being brought into a locking position through the rod; and the rod having a leading bevel edge for the purpose of radially displacing the locking members to said locking position.

2. The rifle according to claim 1, wherein in the forearm is provided with a sleeve-like projection for the reception of the locking device.

3. The rifle according to claim 2, wherein the stock is provided with a bore for reception of the sleeve-like projection.

4. The rifle according to claim 3, wherein the bore is lined with a sleeve.

5. The rifle according to claim 2, wherein, in the region of the leading bevel edge, the sleeve-like projection is provided with apertures for the locking members, said apertures being spaced around the circumference.

6. The rifle according to claim 4, wherein there are provided engaging means for the locking members on the inner circumference in the sleeve or in the bore respectively of the stock.

7. The rifle according to claim 6, wherein the engaging means is configured to form a tangentially contouring groove disposed on the inner circumference of the sleeve, or of the bore, of the stock.

8. The rifle according to claim 1, wherein the actuation member of the rod extends through the forearm parallel to the longitudinal axis thereof.

9. The rifle according to claim 1, wherein the barrel has a tongue and the stock has a housing having a groove which is oriented parallel to the longitudinal axis and into which a tongue of the barrel is slidably isertable provided beneath said housing, said groove being blockable by the forearm.

* * * * *